US011808258B2

(12) United States Patent
Shimamoto et al.

(10) Patent No.: US 11,808,258 B2
(45) Date of Patent: Nov. 7, 2023

(54) CALIBRATION SYSTEM FOR VARIABLE CAPACITY HYDRAULIC PUMP

(71) Applicant: Caterpillar SARL, Geneva (CH)

(72) Inventors: Atsunori Shimamoto, Akashi (JP); Naoki Sawada, Akashi (JP)

(73) Assignee: Caterpillar SARL, Geneva (CH)

( * ) Notice: Subject to any disclaimer, the term of this patent is extended or adjusted under 35 U.S.C. 154(b) by 491 days.

(21) Appl. No.: 17/047,210

(22) PCT Filed: Apr. 17, 2019

(86) PCT No.: PCT/EP2019/025112
§ 371 (c)(1),
(2) Date: Oct. 13, 2020

(87) PCT Pub. No.: WO2019/206456
PCT Pub. Date: Oct. 31, 2019

(65) Prior Publication Data

US 2021/0156373 A1 May 27, 2021

(30) Foreign Application Priority Data

Apr. 27, 2018 (JP) ..... 2018-086839

(51) Int. Cl.
*F04B 49/06* (2006.01)
*F04B 49/08* (2006.01)
(Continued)

(52) U.S. Cl.
CPC ..... *F04B 49/065* (2013.01); *F04B 49/08* (2013.01); *F04B 51/00* (2013.01); *E02F 9/2235* (2013.01);
(Continued)

(58) Field of Classification Search
CPC ..... F04B 1/295; F04B 1/324; F04B 49/065; F04B 49/08; F04B 49/12;
(Continued)

(56) References Cited

U.S. PATENT DOCUMENTS 8,321,114 B2 * 11/2012 Kamado ..... E02F 9/264 701/84
2010/0186713 A1 * 7/2010 Kawaguchi ..... E02F 9/2246 123/350
(Continued)

FOREIGN PATENT DOCUMENTS

JP 2008303813 A * 12/2008
JP 2008303813 A 12/2008
(Continued)

OTHER PUBLICATIONS

International Search Report for related International Application No. PCT/EP201 9/025112; report dated Jul. 15, 2019.

*Primary Examiner* — Alexander B Comley

(57) ABSTRACT

Providing high accuracy calibration of a pump control table when variable capacity of a hydraulic pump is controlled based on a pump control table representing the relationship between pump capacity and current command value. The calibration: acquires data by measuring pump pressure corresponding to each current command value while changing the current command value in a multi-step manner; obtains a factor K representing a relationship between pump pressure and pump flow rate; creates a first table representing a relationship between the factor K and pump pressure; creates a second table representing a relationship between current command value and pump pressure; creates a third table representing a relationship between pump flow rate and current command value according to factor K; and creates a pump control table representing a relationship between
(Continued)

pump capacity and current command value through engine rotation speed during pump pressure measurement.

3 Claims, 6 Drawing Sheets

(51) Int. Cl.
*F04B 51/00* (2006.01)
*E02F 9/22* (2006.01)

(52) U.S. Cl.
CPC ..... *E02F 9/2296* (2013.01); *F04B 2203/0209* (2013.01); *F04B 2205/05* (2013.01); *F04B 2205/09* (2013.01)

(58) Field of Classification Search
CPC ..... F04B 49/123–125; F04B 51/00; F04B 2203/0209; F04B 2205/05; F04B 2205/09; E02F 9/2235; E02F 9/2296
See application file for complete search history.

(56) References Cited

U.S. PATENT DOCUMENTS

2016/0025113 A1* 1/2016 Hiraku ..... F15B 13/06 60/428
2016/0341193 A1* 11/2016 Du ..... F04B 17/05

FOREIGN PATENT DOCUMENTS

JP 2014177969 A * 9/2014
JP 2014177969 A 9/2014

* cited by examiner

CALIBRATION SYSTEM FOR VARIABLE CAPACITY HYDRAULIC PUMP

CROSS-REFERENCE TO RELATED APPLICATION

This Application is a 35 USC § 371 US National Stage filing of International Application No. PCT/EP2019/025112 filed on Apr. 17, 2019 which claims priority under the Paris Convention to Japanese Patent Application No. 2018-086839 filed on Apr. 27, 2018.

FIELD OF THE INVENTION

The present invention relates to a calibration system for variable capacity hydraulic pump whose capacity is variably controlled based on current command value output from a controller.

BACKGROUND ART

In general, in hydraulic working machines including hydraulic excavator, a variable capacity hydraulic pump is generally used which variably controls its capacity based on a current command value output from the controller, wherein those controllers are well-known which are configured to be installed with a table representing a correspondence relation between a pump capacity (or a pump flow rate) and current command value and output current command value acquired by using the table from the controllers.

The table is prepared in advance according to a specification and saved in the controller which represents the correspondence relation between the pump capacity and current command value, the current command value is output by using the specification-based table, but a deviation sometimes happens between the pump capacity value corresponding to an current command value output from the specification-based table and actual pump capacity value because of a variation in manufacturing, a change across the ages, etc.

Therefore, conventionally, as calibration to match values in the specification-based table with actual values, one technology is known to calculate current command value at least one of actual minimum and maximum swash plate positions corresponding to change points of pressure value acquired by changing the current command value while monitoring pressure values acting on an actuator piston variably adjusting a swash plate tilt angle and compensate the current command value by using a difference between this actual and specification-based current command values as a compensated value (see patent document 1, for example), and another technology is known to update control parameter (specification-based table) relating to the current command value based on current command values and discharge pressures at maximum and minimum discharge flow rates of the hydraulic pump (see patent document 2, for example). According to these patent documents 1, 2, their simple configuration enables the calibration at low cost without the needs of swash plate tilt angle sensor and flow meter for calibration.

CITATION LIST

Patent Documents

PTL 1: Japanese Unexamined Patent Application Publication No. 2008-303813

PTL 2: Japanese Unexamined Patent Application Publication No. 2014-177969

SUMMARY OF INVENTION

Problem to be Solved by the Invention

When making the calibration of the pump capacity (pump flow rate) corresponding to the current command value of hydraulic pump, both methods according to these patent documents 1, 2 mentioned above are configured to calculate a calibration value of the current command value corresponding to maximum and maximum flow rates (swash plate positions) as change points of pressure and calibrate the current command value corresponding to any intermediate flow rate between minimum and maximum flow rates by using the calibration value. That is, the calibration value which corresponds to intermediate current command value and sets the hydraulic pump to any intermediate flow rate is not acquired but the current command value is calibrated as a whole by only using the calibration value of the current command value corresponding to minimum and maximum flow rates as change points of pressure. However, since the pressure is too low when the hydraulic pump is at minimum flow rate, it is difficult to find exact change points of pressure, and also since the engine output may drop when the hydraulic pump is at maximum flow rate, it is also difficult to find exact change points of pressure, so it is hard to accurately calculate the calibration value of the current command values corresponding to minimum and maximum flow rates as change points of pressure. In other words, the methods according to patent documents 1, 2 calibrate the current command value as a whole only with calibration value corresponding to minimum and maximum flow rates which are hard to accurately calculate, so the calibration has lower accuracy and this is a problem to be solved by the invention.

Means for Solving the Problem

The present invention was, in consideration of actual situation as noted above, intended to solve this problem, wherein the invention according to the claim 1 is a calibration system for variable capacity hydraulic pump, the calibration system comprising: when installing the calibration system calibrating a pump control table into a hydraulic control circuit comprising: a hydraulic pump being driven by an engine and having a capacity variably controlled based on current command value for a capacity control; and a controller having the pump control table representing a relationship between the pump capacity and current command value and outputting current command value for the capacity control based on the pump control table; a calibration data acquisition means for acquiring measured pump pressure data corresponding to each current command value by measuring a pump pressure in each current command value while changing current command value output from the controller in a multi-step manner from minimum to maximum current command value; a first table creation means, by calculating a factor representing a relationship between the pump pressure and pump flow rate based on the pump flow rate obtained from specification-based pump capacity at preset current command criterion value and the measured pump pressure acquired by the calibration data acquisition means, to create a first table representing a relationship between the factor and pump pressure; a second table creation means to create a second table representing a relationship between each current command value and measured pump pressure based on the data acquired by the calibration data acquisition means; a third table creation means, by converting the measured pump pressure in the second table into the pump flow rate using the factor in the first table, to create a third table representing a relationship between the pump flow rate and current command value; and a pump control table creation means to create the pump control table representing a relationship between the pump capacity and current command value based on an engine rotation speed during pump pressure measurement and the third table; wherein the pump control table created by the pump control table creation means is used as the pump control table calibrated.

The invention according to claim 2 is the calibration system for variable capacity hydraulic pump, wherein the calibration data acquisition means is configured to obtain the calibration data sequentially from each hydraulic pump, while the hydraulic control circuit according to the claim 1 includes multiple variable capacity hydraulic pumps, and wherein the calibration data of the hydraulic pump is, while keeping the current command value constant which is output to other than the hydraulic pump obtaining the calibration data, acquired by changing the current command value for the hydraulic pump.

The invention according to claim 3 is the calibration system for variable capacity hydraulic pump, wherein the calibration data is, in claim 1 or 2, acquired by the calibration data acquisition means under a condition that the engine rotation speed is kept constant and the pump pressure increases as the pump capacity increases.

Effects of the Invention

According to the invention of claim 1, the pump control table can be created where the pump capacity value corresponding to each current command value is calibrated all over the current command values, so that the pump control table can be calibrated high-accurately.

According to the invention of claim 2, two or more hydraulic pumps are installed, and the calibration data for each hydraulic pump can be acquired smoothly even in the hydraulic control circuit which is configured to join oil discharged from these hydraulic pumps.

According to the invention of claim 3, the measured pump pressure data corresponding to each current command value can be accurately acquired.

DESCRIPTION OF EMBODIMENT

Figure 1:
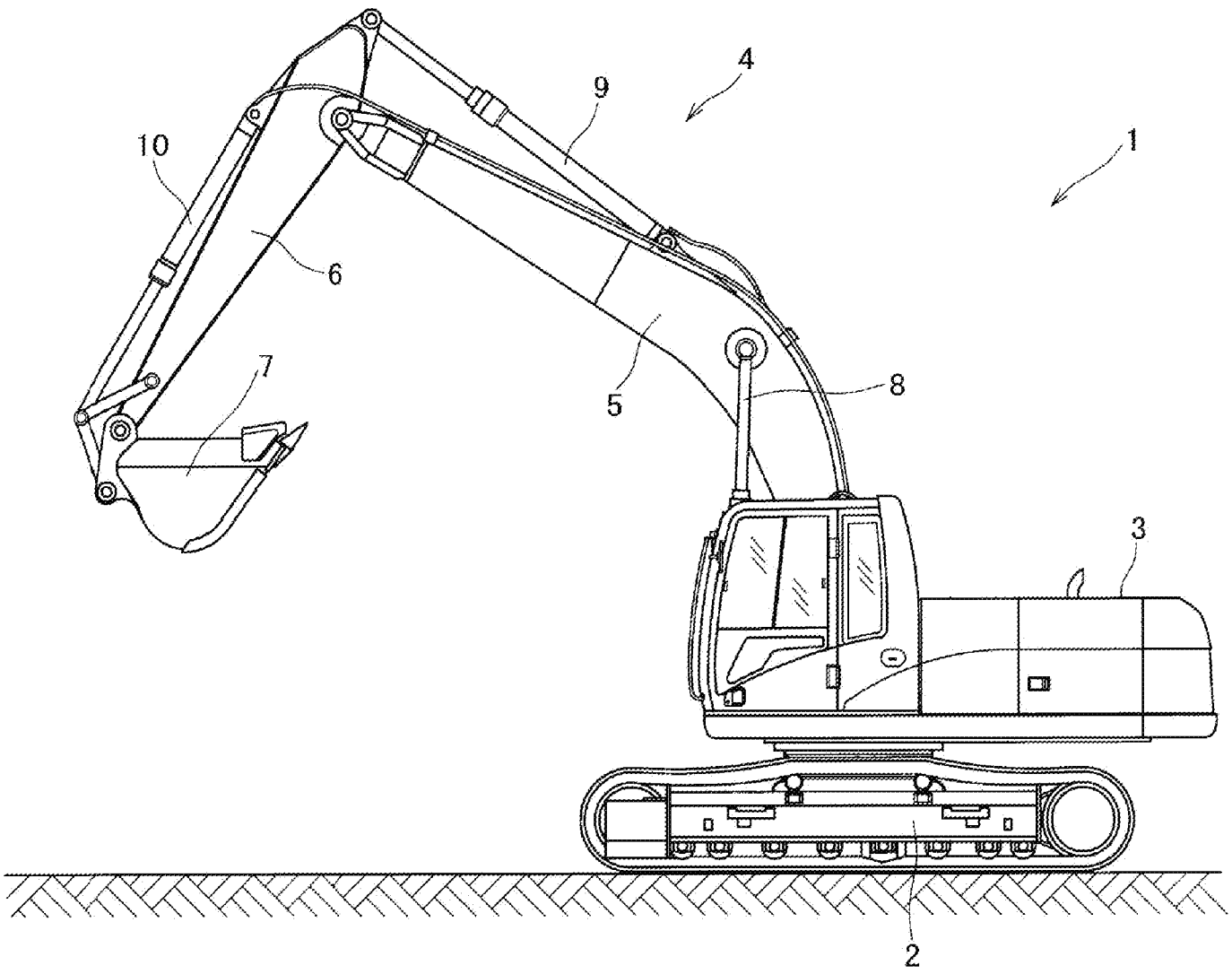
FIG. 1 is a side view of a hydraulic excavator.

Now, an explanation is provided below on embodiments of the present invention based on drawings. In the FIG. 1, 1 indicates a hydraulic excavator relating to the present embodiment, wherein the hydraulic excavator 1 includes a crawler type lower traveling body 2, an upper swiveling body 3 swivelably supported above the lower traveling body 2, and a front working part 4 mounted on the upper swiveling body 3, and furthermore, the front working part 4 includes a boom 5 whose base end part is supported vertically swingably by the upper swiveling body 3, a stick 6 longitudinally swingably supported at an end part of the boom 5, a bucket 7 swivelably supported at an end part of the stick 6, and others, wherein the hydraulic excavator 1 has left and right traveling motors (not shown) for moving the lower traveling body 2, a swiveling motor (not shown) for swiveling the upper swiveling body 3, boom cylinder 8 for swinging the boom 5, stick 6, and bucket 7 respectively, and various hydraulic actuators such as a stick cylinder 9 and a bucket cylinder 10.

Figure 2:
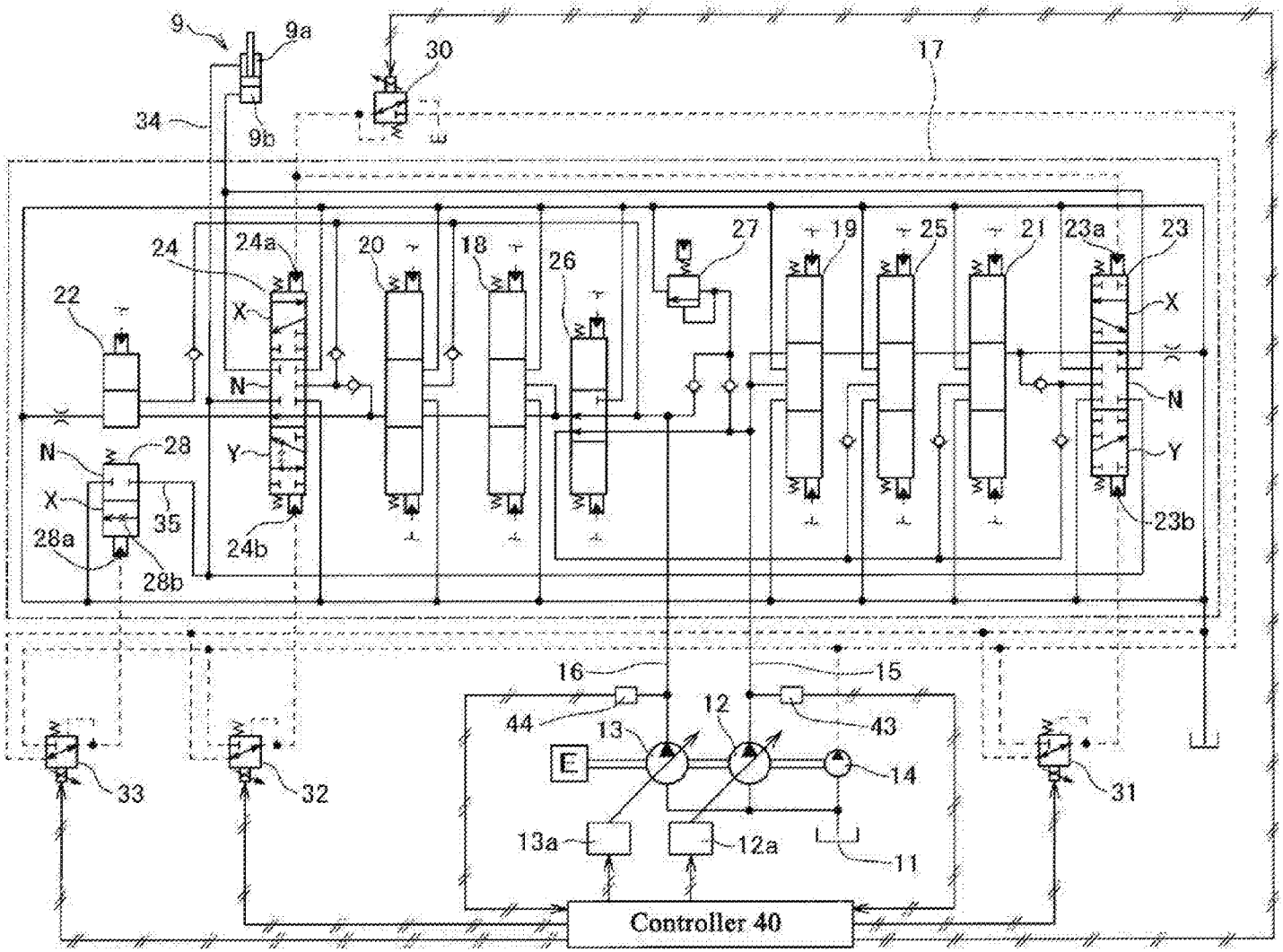
FIG. 2 is a hydraulic control circuit diagram of the hydraulic excavator.

Thereafter, an explanation about the hydraulic control circuit installed in the hydraulic excavator 1 is provided based on the FIG. 2. In the FIG. 2, the number 11 indicates an oil tank, the numbers 12, 13 indicate first and second hydraulic pumps of variable capacity type as hydraulic sources of the hydraulic actuator, the number 14 indicates pilot pump as a hydraulic source of pilot pressure, wherein these first and second hydraulic pumps 12, 13 and pilot pump 14 are driven by an engine E. Also, the numbers 12*a*, 13*a* indicate regulators (variable capacity means) making a capacity of the first and second hydraulic pumps 12, 13 variable, wherein the regulators 12*a*, 13*a* are configured that current commands for controlling their capacity are input from a controller 40 described later so that the pump capacity (displacement volume) of the first and second hydraulic pumps 12, 13 is made variable based on the current command value for controlling their capacity.

In the FIG. 2, the numbers 15, 16 indicate first and second discharge lines to which the discharge oil is supplied from the first and second hydraulic pumps 12, 13, the number 17 indicates a control valve unit connected to these first and second discharge lines 15, 16, wherein, into the control valve unit 17, respective left and right traveling, swiveling, first boom, second boom, first stick, second stick, and bucket control valves 18 to 25 which control an oil feed/discharge to the left and right traveling motors, swiveling motor, boom cylinder 8, stick cylinder 9, and bucket cylinder 10 each, straight travel valve 26, main relief valve 27 setting circuit pressure for the first and second discharge lines, gravity fall prevention valves (all of them are not shown) for the boom and stick, cylinder relief valves (all of them are not shown) for setting a circuit pressure for the boom cylinder 8, stick cylinder 9, bucket cylinder 10 each, an stick unload valve 28 (mentioned later), and others are incorporated.

The respective left and right traveling, swiveling, first boom, second boom, first stick, second stick, and bucket control valves 18 to 25 are configured to be started up by the pilot pressure output based on a manipulator operation to control the oil feed/discharge of the corresponding hydraulic actuator (left and right traveling motors, swiveling motor, boom cylinder 8, stick cylinder 9, and bucket cylinder 10); and in the present embodiment, since the calibration mentioned later of first and second hydraulic pumps 12, 13 is configured to be conducted while the stick cylinder 9 is fixed at a contracted side (outside) end, an explanation is provided below on first and second stick control valves 23, 24, and stick unload valve 28 for controlling oil feed/discharge for the stick cylinder 9; and further, contracted side stick solenoid valve 30, first and second extended side stick solenoid valves 31, 32, and unload solenoid valve 33 for outputting pilot pressure to these valves 23, 24, and 28. Note that, in the FIG. 2, other hydraulic actuators than the stick cylinder 9, oil passages for connecting these other hydraulic actuators and control valves for other hydraulic actuators, solenoid valves outputting pilot pressure to control valves for these other hydraulic actuators, and others are omitted.

The first stick control valve 23 is a pilot operated type direction change-over valve having pilot ports 23*a*, 23*b* at contracted and extended sides, wherein, the first stick control valve 23 is configured that, when the pilot pressure is not input into both pilot ports 23*a*, 23*b*, the valve 23 is at a neutral position N where the oil is not fed/discharged to the stick cylinder 9, and when the pilot pressure is input into the contracted side pilot port 23*a*, the valve 23 switches to a contracted side operation position X to supply the discharge oil of the first hydraulic pump 12 to a rod side oil chamber 9*a* of the stick cylinder 9 and drain the drainage oil from a head side oil chamber 9*b* to an oil tank 11, and when the pilot pressure is input into the extended side pilot port 23*b*, the valve 23 switches to an extended side operation position Y to supply the discharge oil of the first hydraulic pump 12 to a head side oil chamber 9*b* of the stick cylinder 9.

The second stick control valve 24 is a pilot operated type direction change-over valve having pilot ports 24*a*, 24*b* at contracted and extended sides, wherein, the second stick control valve 24 is configured that, when the pilot pressure is not input into both pilot ports 24*a*, 24*b*, the valve 24 is at a neutral position N where the oil is not fed/discharged to the stick cylinder 9, and when the pilot pressure is input into the contracted side pilot port 24*a*, the valve 24 switches to the contracted side operation position X to supply the discharge oil of the second hydraulic pump 13 to a rod side oil chamber 9*a* of the stick cylinder 9 and drain the drainage oil from a head side oil chamber 9*b* to the oil tank 11, and when the pilot pressure is input into the extended side pilot port 24*b*, the valve 24 switches to the extended side operation position Y to supply the discharge oil of the second hydraulic pump 13 to a head side oil chamber 9*b* of the stick cylinder 9 and supply drainage oil from the rod side oil chamber 9*a* to the head side oil chamber 9*b* as regenerated oil and drain remaining oil into the oil tank 11.

Also, the stick unload valve 28 is a pilot operated type on-off valve to open/close an unload oil passage 35 being branched from a stick cylinder rod side oil passage 34 connecting the first and second stick control valves 23, 24 and the rod side oil chamber 9*a* of the stick cylinder 9 and reaching to the oil tank 11, wherein the stick unload valve 28 is configured that when the pilot pressure is not input into a pilot port 28*a*, the valve 28 is at a neutral position N closing the unload oil passage 35, and when the pilot pressure is input into the pilot port 28*a*, the valve 28 switches to an open position X opening the unload oil passage 35 to drain oil of a stick cylinder rod side oil passage 34 to the oil tank 11 via orifice 28*b*.

Also, the contracted side stick solenoid valve 30, first and second extended side stick solenoid valves 31, 32, and unload solenoid valve 33 are proportional solenoid valve outputting the pilot pressure based on commands from the controller 40, wherein, during normal operation where the pump calibration mentioned later is not conducted, the pilot pressure is output in order to actuate the stick 6 according to an operation of a stick manipulator (not shown). That is, when the stick manipulator is operated to a stick out side (contracted side of stick cylinder 9) during normal operation, a control command for outputting the pilot pressure to contracted side pilot ports 23*a*, 24*a* of the first and second stick control valves 23, 24 is output from the controller 40 to the contracted side stick solenoid valve 30. Herewith, the first and second stick control valves 23, 24 switches to the contracted side operation position X, so that, while the discharge oil of the first and second hydraulic pumps 12, 13 is supplied to the rod side oil chamber 9*a* of the stick cylinder 9, the drainage oil is drained to the oil tank 11, and the stick cylinder 9 is contracted. Also, when the stick manipulator is operated to a stick in side (extended side of stick cylinder 9) during normal operation, a control command for outputting the pilot pressure to the extended side pilot ports 23*b*, 24*b* of the first and second stick control valves 23, 24 is output from the controller 40 to the first and second extended side stick solenoid valves 31, 32. Herewith, the first and second stick control valves 23, 24 switches to the extended side operation position X, so that, while the discharge oil of the first and second hydraulic pumps 12, 13 is supplied to the head side oil chamber 9*b* of the stick cylinder 9, the drainage oil from the rod side oil chamber 9*a* is supplied to the head side oil chamber 9*b* as regenerated oil, remaining oil is drained into the oil tank 11, and the stick cylinder 9 is extended. Furthermore, when a pressure in the rod side oil chamber 9*a* is not higher than that in the head side oil chamber 9*b* while the stick cylinder 9 is extending, the oil is not regenerated from the rod side oil chamber 9*a* to the head side oil chamber 9*b*, wherein a control command for outputting the pilot pressure to the pilot port 28*a* of the stick unload valve 28 is output from the controller 40 to the unload solenoid valve 33. Herewith, the stick unload valve 28 switches to the open position X to enable to drain the drainage oil from the rod side oil chamber 9*a* to the oil tank 11 via the unload oil passage 35. Note that the control of stick cylinder 9 during pump calibration will be mentioned later.

On the one hand, the controller 40 is a control device configured to comprise CPU, memory, and others, wherein, during normal operation where the pump calibration mentioned later is not conducted, the controller inputs signals from operation of the manipulator for each hydraulic actuator, discharge pressure of the first and second hydraulic pumps 12, 13, engine controller, accelerator dial, various operation mode setting means, etc., and based on these input signals, calculates hydraulic actuator-required flow rate requested by each hydraulic actuator and pump-required flow rate requested by the first and second hydraulic pumps 12, 13. Also, the controller 40 is configured to output the control command corresponding to the calculated required-flow rate of hydraulic actuator to solenoid valves (left and right solenoid valves for traveling (not shown), solenoid valves for swiveling, boom, and bucket, the contracted side stick solenoid valve 30, first and second extended side stick solenoid valves 31, 32, unload solenoid valve 33, etc.) which outputs the pilot pressure to the control valves 18 to 25 and stick unload valve 28, to control the oil feed/discharge of each hydraulic actuator, and output the control command for keeping the pump capacity corresponding to the pump-required flow rate to regulators 12*a*, 13*a* of the first and second hydraulic pumps 12, 13 to control the flow rate of the first and second hydraulic pumps 12, 13.

Here, the control command output from the controller 40 to the regulator 12*a*, 13*a* is a current command for controlling the pump capacity to make the pump capacity of the first and second hydraulic pumps 12, 13 variable by responding to the current command value, wherein the controller 40 is configured to have each pump control table 41 representing a correspondence relation between the pump capacity and current command value for the first and second hydraulic pumps 12, 13, and calculate current command value for controlling current for the regulator 12*a*, 13*a* by using the pump control table 41.

In addition, the controller 40 is installed with a calibration part 42 calibrating the pump control table 41. In contrast with the correspondence relation between the pump capacity and current command value shown in the specification-based pump control table 41, the actual correspondence relation between the pump capacity and current command value has as much variation as a tolerance and may be deviated further with time, so in order to match the pump control table 41 with actual correspondence relation between the pump capacity and current command value, the calibration can be conducted with a pump calibration work conducted by the calibration part 42 installed in the controller 40.

Figure 3:
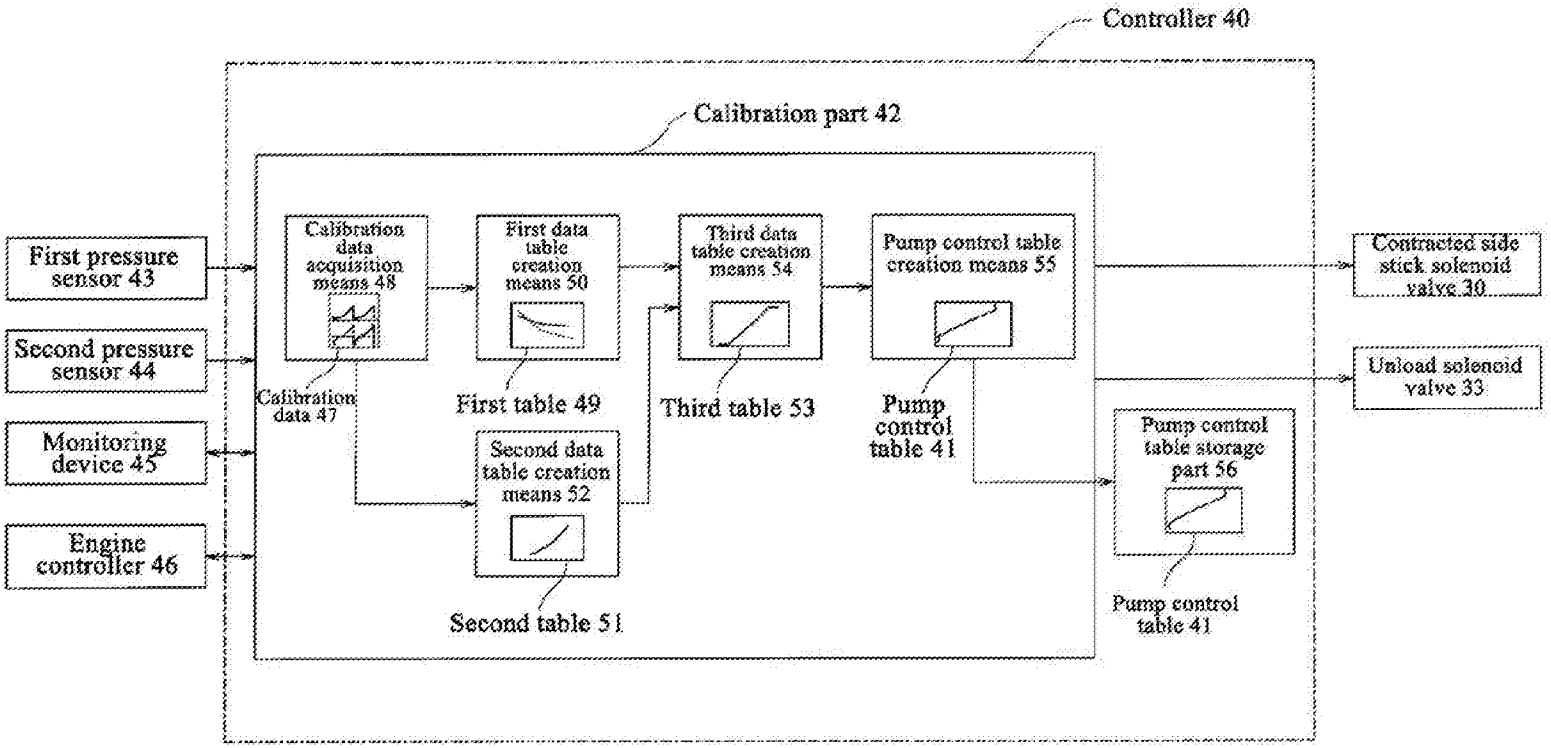
FIG. 3 is a control block diagram of calibration part.

As illustrated in the control block diagram in FIG. 3, the calibration part 42 is configured to be connected to first and second pressure sensors 43, 44 detecting the discharge pressure (pump pressure) of the first and second hydraulic pumps 12, 13 respectively, a monitoring device 45 arranged in an operating room of the hydraulic excavator 1, an engine controller 46 controlling the engine E, the contracted side stick solenoid valve 30, and unload solenoid valve 33, etc., and comprise a calibration data acquisition means 48 for acquiring calibration data 47 mentioned later, first and second table creation means 50, 52 for creating first and second tables 49, 51, the third table creation means 54 for creating a third table 53, the pump control table creation means 55 for creating the pump control table 41 calibrated, and others. Also, the number 56 in FIG. 3 is a pump control table storage part installed in the controller 40, wherein each pump control table 41 of the first and second hydraulic pumps 12, 13 is saved in the pump control table storage part 56, and in initial state, the specification-based pump control table 41 is saved.

Note that the FIG. 3 illustrates the section only relating to the pump calibration of all various controls conducted by the controller 40. The monitoring device 45 comprises a display and operation means capable of displaying various device information of the hydraulic excavator 1 and conducting various settings, and the monitoring device 45 is configured in the present embodiment to progress the pump calibration work by an operator's manipulation of the monitoring device, and it is to be understood that the pump calibration work is not restricted to such monitoring device but is able to be configured to conduct the work by using other operation means (switch, button, etc.)

Thereafter, an explanation is provided on a pump calibration control conducted by the calibration part 42. When an operation signal to start the calibration work is input from the monitoring device 45, after configuring necessary initial setting, the calibration data 47 is acquired by the calibration data acquisition means 48. In this case, the calibration data acquisition means 48 sets, as a preparatory control for acquiring the calibration data 47 at first, an engine rotation speed to preset engine rotation speed Ns. After the prescribed time lapsed which is configured to be the preset rotation speed Ns, the means outputs a control command to output the pilot pressure to the contracted side stick solenoid valve 30 and unload solenoid valve 33 in order to switch the first and second stick control valves 23, 24 and stick unload valve 28 to the contracted side operation position X and open position X of maximum stroke. Herewith, the first and second stick control valves 23, 24 switch to the contracted side operation position X, so that, while the discharge oil of the first and second hydraulic pumps 12, 13 is supplied to the rod side oil chamber 9*a* of the stick cylinder 9, the drainage oil from the head side oil chamber 9*b* is drained to the oil tank 11, and the stick cylinder 9 is contracted. Furthermore, after the stick cylinder 9 reached to a contracted side end by switching the stick unload valve 28 to the open position X, the discharge oil of the first and second control valves 12, 13 flows to the oil tank 11 via the first and second stick control valves 23, 24 at contracted side operation position X, stick cylinder rod side oil passage 34, and unload oil passage 35. In this state, even if the pump capacity of first and second hydraulic pumps 12, 13 changes over to maximum, the pump pressure does not rise until the engine E becomes short of power, thus an acquisition of calibration data 47 mentioned later will be possible until the engine rotation speed is kept at the preset rotating speed Ns and the pump capacity reaches to maximum under a condition of increase of the pump pressure in association with an increase of the pump capacity.

Figure 4:
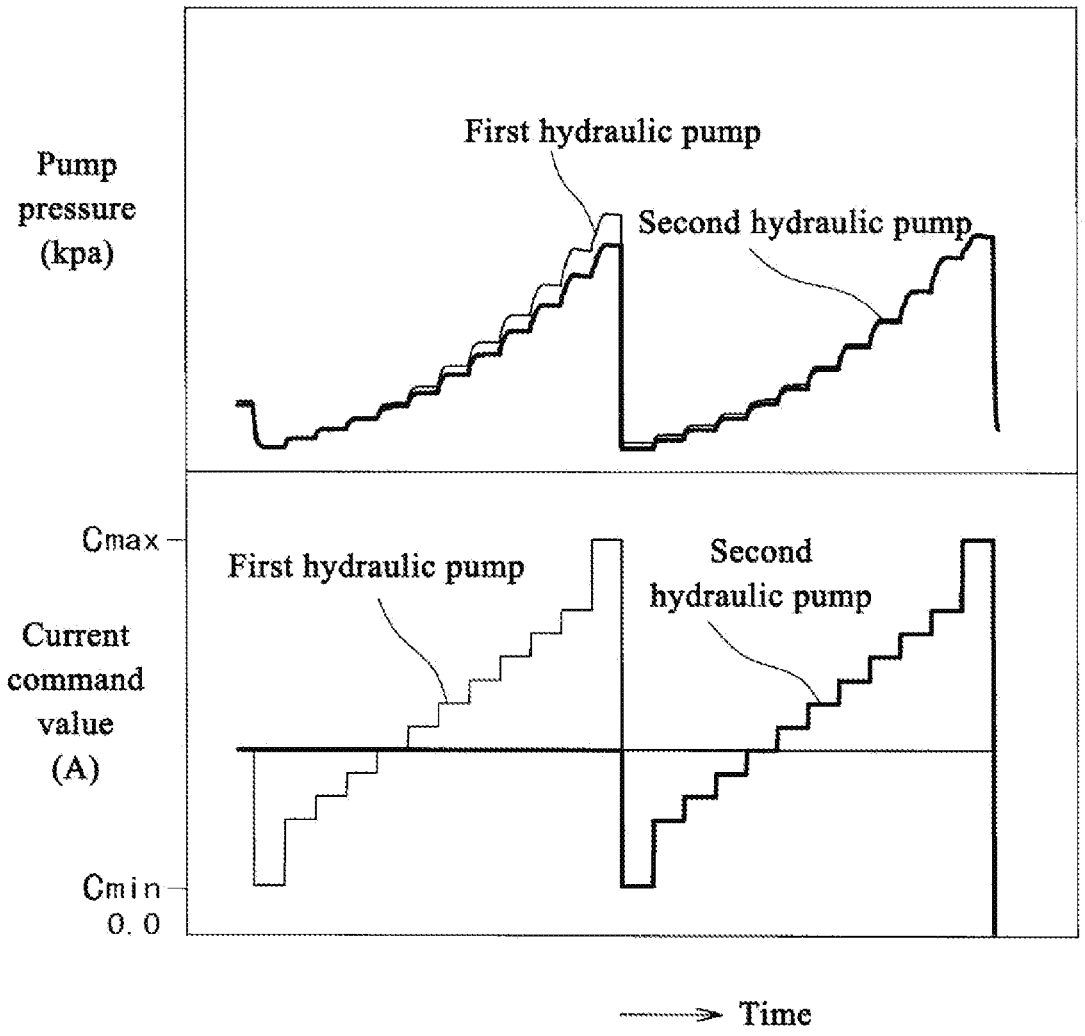
FIG. 4 is a drawing indicating calibration data.

Furthermore, the calibration data acquisition means 48 acquires the calibration data 47 while keeping the preparatory control mentioned above. This calibration data 47 acquisition is performed on the first and second hydraulic pumps 12, 13 each, wherein, when acquiring the calibration data 47 for the first hydraulic pump 12, while the current command value for the regulator 13*a* of the second hydraulic pump 13 is kept at a constant of preset current command value $C_{fix}$, the measured pump pressure data corresponding to the current command value of the first hydraulic pump 12 is acquired by measuring the pump pressure of the first hydraulic pump 12 at each current command value while changing the current command value for the first hydraulic pump 12 in a multi-step manner from minimum to maximum current command values $C_{min}$ to $C_{max}$. Also, when acquiring the calibration data 47 for the second hydraulic pump 13, while the current command value for the regulator 12*a* of the first hydraulic pump 12 is kept at a constant of preset current command value $C_{fix}$, the measured pump pressure data corresponding to the current command value of the second hydraulic pump 13 is acquired by measuring the pump pressure of the second hydraulic pump 13 at each current command value while changing the current command value for the second hydraulic pump 13 in a multi-step manner from minimum to maximum current command values $C_{min}$ to $C_{max}$. An example of this calibration data 47 is shown in the FIG. 4, wherein, in the calibration data 47 shown in the FIG. 4, when acquiring calibration data 47 for either one of hydraulic pumps 12, 13, the pump pressure of both hydraulic pumps 12, 13 is measured. Also, when acquiring the calibration data 47, the minimum (minimum current command value) $C_{min}$ and maximum (maximum current command value) $C_{max}$ are, by considering the value in the specification-based pump control table 41 and the tolerance, set to the value which fully can cover minimum to maximum pump capacities of the first and second hydraulic pumps 12, 13. The calibration data 47 acquired by the calibration data acquisition means 48 is input into first and second table creation means 50, 52.

The first table creation means 50 into which the calibration data 47 is input calculates coefficients K1, K2 representing the relationship between the pump pressure and pump flow rate of the first and second hydraulic pumps 12, 13 each based on the pump flow rate obtained from specification-based pump capacity at preset multiple current command criterion values and measured pump pressure acquired from the calibration data acquisition means 48 at current command criterion value. The coefficients K1, K2 are coefficients representing a proportional relationship between square of the pump flow rate and pump pressure and are represented with the following equations (1), (2):

$$K1=(Q1+Q2)^2/P1 \quad (1)$$

$$K2=(Q1+Q2)^2/P2 \quad (2)$$

In the equation (1) above, Q1 is the pump flow rate of the first hydraulic pump 12 obtained from specification-based pump flow rate at current command criterion value, Q2 is the pump flow rate of the second hydraulic pump 13 obtained from specification-based pump flow rate at the preset current command value $C_{fix}$, and P1 is the measured pump pressure of the first hydraulic pump 12 acquired by the calibration data acquisition means 48 at the current command criterion value. Also, in the equation (2) above, Q1 is the pump flow rate of the first hydraulic pump 12 obtained from specification-based pump flow rate at the preset current command value $C_{fix}$, Q2 is the pump flow rate of the second hydraulic pump 13 obtained from specification-based pump capacity at current command criterion value, and P2 is the measured pump pressure of the second hydraulic pump 13 acquired by the calibration data acquisition means 48 at the current command criterion value. Here, the current command criterion value is multiple current command values at least including minimum and maximum current command value $C_{min}$ and $C_{max}$, wherein, in the present embodiment, the minimum and maximum current command values $C_{min}$ and $C_{max}$ and an intermediate current command value $C_{mid}$ representing almost a median changing during calibration data acquisition are set as current command criterion values, but the criterion values are not limited to these values and the number of them can be increased. Also, when obtaining the pump flow rates of the first and second hydraulic pumps 13 from specification-based pump capacity at the current command criterion values, the pump flow rate can be obtained by multiplying the pump capacity by the engine rotation speed (preset engine rotation speed Ns).

Figure 5A:
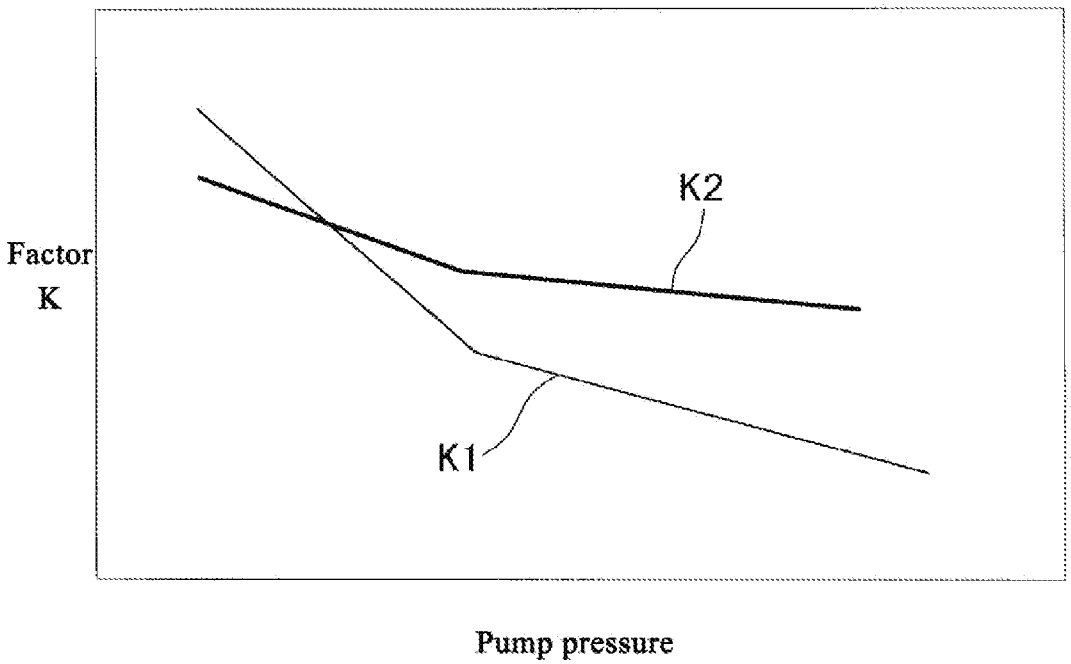
FIG. 5*a* is a drawing indicating first table and FIG. b is a drawing indicating second table.

Further, the first table creation means 50 creates the first table 49 representing the relationship between the coefficients K1, K2 and pump pressure by using the coefficients K1, K2 representing the relationship between the pump pressure and pump flow rate of the first and second hydraulic pumps 12, 13 at current command criterion value obtained as mentioned above, and the measured pump pressure of the first and second hydraulic pumps 12 acquired by the calibration data acquisition means 48 at the current command criterion value (an example of the first table 49 is shown in the FIG. 5*a*). The data in the first table 49 created by the first table creation means 50 is input into the third table creation means 54.

Figure 5B:
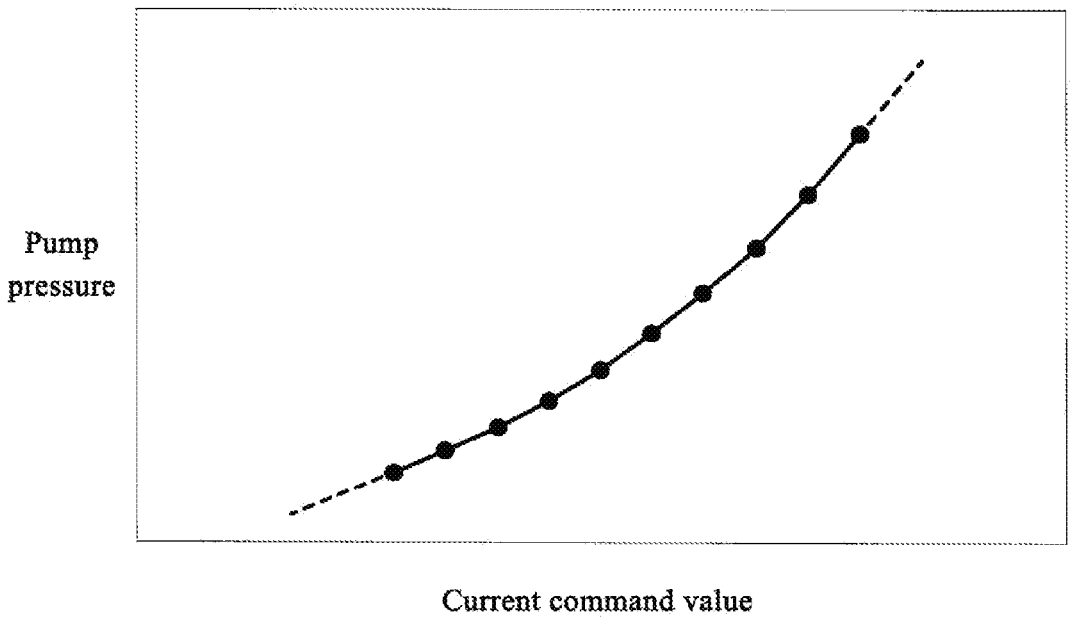

The second table creation means 52 where the calibration data 47 is input creates a second table 51 representing the correspondence relation between each current command value and pump pressure for each of the first and second hydraulic pumps 12, 13 based on the calibration data 47 (an example of the second table 51 is shown in FIG. 5*b*, and the FIG. 5*b* illustrates the second table 51 only for the first hydraulic pump 12). The data in the second table 51 created by the second table creation means 52 is input into the third table creation means 54.

Figure 6A:
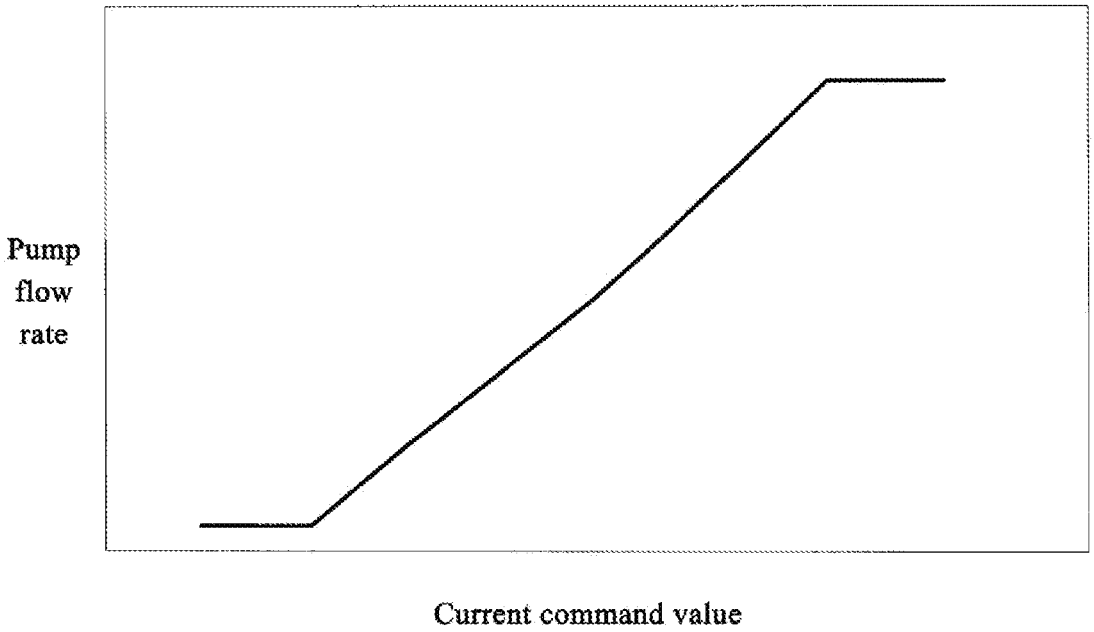
FIG. 6*a*, is a drawing indicating third table, and FIG. b is a drawing indicating a pump control table.

The third table creation means 54 where the data of the first and second tables 49, 51 is input converts the pump pressure of the second table 51 into the pump flow rate by using the coefficients K1, K2 of the first table 49 and creates the third table 53 representing the relationship between the pump flow rate and current command value for each of the first and second hydraulic pumps 12, 13 (an example of the third table 53 is shown in FIG. 6*a*, and the FIG. 6*a* illustrates the third table 53 only for the first hydraulic pump 12). To convert the pump pressure of the second table 51 into the pump flow rate by using the coefficients K1, K2, use the following equations (3), (4):

$$Q1=(K1(P1)\times P1)^{1/2}-Q2 \quad (3)$$

$$Q2=(K2(P1)\times P2)^{1/2}-Q1 \quad (4)$$

In the equation (3), Q1 is the pump flow rate of the first hydraulic pump 12, P1 is the pump pressure corresponding to each current command value in the second table 51 for the first hydraulic pump 12, K1(P1) is the coefficient corresponding to each pump pressure P1 in the first table 49 for the first hydraulic pump 12, and Q2 is the pump flow rate of the second hydraulic pump 13 obtained from the specification-based pump capacity at the preset current command value $C_{fix}$. In the equation (4), Q2 is the pump flow rate of the second hydraulic pump 13, P2 is the pump pressure corresponding to each current command value in the second table 51 for the second hydraulic pump 13, K2(P2) is the coefficient corresponding to each pump pressure P2 in the first table 49 for the second hydraulic pump 13, and Q1 is the pump flow rate of the first hydraulic pump 12 obtained from the specification-based pump capacity at the preset current command value $C_{fix}$. The data in the third table 53 created by the third table creation means 54 is input into the pump control table creation means 55.

Figure 6B:
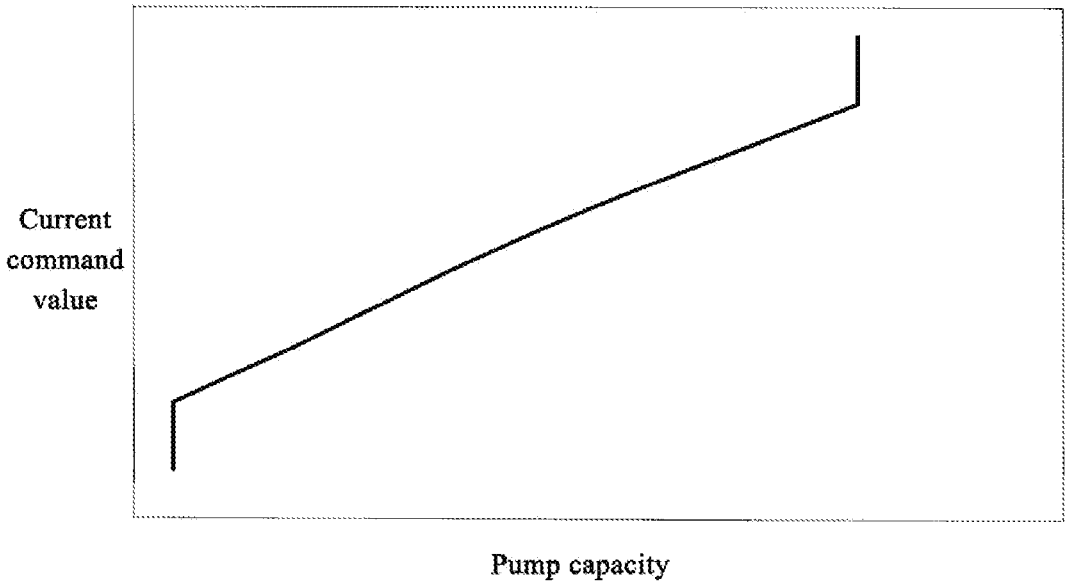

The pump control table creation means 55 where the data of the third table 53 is input converts the pump flow rate of the third table 53 into the pump capacity by dividing the pump flow rate of the third table 53 by the preset engine rotation speed Ns (engine rotation speed when the calibration data acquisition means 48 measures the pump pressure), and creates the pump control table 41 representing the relationship between the pump capacity and current command value for each of the first and second hydraulic pumps 12, 13 (an example of the pump control table 41 is shown in FIG. 6*b*, and the FIG. 6*b* illustrates the pump control table 41 only for the first hydraulic pump 12). The pump control table 41 created is output to the pump control table storage part 56 as the pump control table 41 calibrated. When the pump control table 41 calibrated is input from the pump control table creation means 55, the pump control table storage part 56 updates existing pump control table 41 with the pump control table 41 calibrated and save the table. Herewith, the calibration work of first and second hydraulic pumps 12, 13 is finished and the monitoring device 45 is notified of the finish. From now on, for a pump capacity control, the pump control table 41 calibrated and saved in the pump control table storage part 56 is used.

As is shown in the description above, in the present embodiment, the controller 40 has the pump control table 41 representing the correspondence relation between the pump capacity and current command value, the pump capacity of the first and second hydraulic pumps 12, 13 is variably controlled with the current command value obtained in the pump control table 41, and further, the controller 40 is equipped with a configuration part 42 calculating the pump control table 41. The calibration part 42 comprises: the calibration data acquisition means 48 to acquire measured pump pressure data (calibration data 47) corresponding to each current command value by measuring the pump pressure in each current command value while changing the current command value output from the controller 40 in a multi-step manner from minimum to maximum current command value $C_{min}$ to $C_{max}$; the first table creation means 50 to create the first table 49 representing the relationship between a factor K and the pump pressure, by obtaining the factor K representing the relationship between the pump pressure and pump flow rate based on the pump flow rate obtained from specification-based pump capacity at preset current command criterion values (in the present embodiment, minimum, maximum, and intermediate current command values $C_{min}$, $C_{max}$, $C_{mid}$) and the measured pump pressure acquired by the calibration data acquisition means 48; the second table creation means 52 to create the second table 51 representing the relationship between each current command value and measured pump pressure based on the calibration data 47; the third table creation means 54, by converting measured pump pressure in the second table 51 into the pump flow rate using the factor K in the first table 49, to create the third table 53 representing the relationship between the pump flow rate and current command value; and the pump control table creation means 55 to create a pump control table 41 representing the relationship between the pump capacity and current command value based on the engine rotation speed during pump pressure measurement (preset engine speed Ns) and the third table 53. The pump control table 41 created in the pump control table creation means 55 is used for the pump capacity control as the pump control table 41 calibrated.

In the present embodiment, the pump control table 41 can be created where the pump capacity value corresponding to each current command value is calibrated all over the current command values, by acquiring the measured pump pressure data (calibration data 47) corresponding to each current command value by measuring the pump pressure in each current command value while changing the current command value in a multi-step manner from minimum to maximum current command value $C_{min}$ to $C_{max}$, and based on the calibration data 47, by creating the first table 49 representing the relationship between the factor K and pump pressure; the second table 51 representing the relationship between each current command value and measured pump pressure; and the third table 53 representing the relationship between the pump flow rate and current command value. In consequence, the pump control table 41 can be highly accurately calibrated to improve a control accuracy of the pump capacity of the first and second hydraulic pumps 12, 13.

Furthermore, in the present embodiment, two first and second hydraulic pumps 12, 13 are installed as the variable capacity hydraulic pump whose capacity is controlled with the current command value from the controller 40, wherein the calibration data acquisition means 48 is configured to acquire the calibration data 47 sequentially for first and second hydraulic pumps 12, 13, and when acquiring the calibration data 47 for the first hydraulic pump 12, acquire the calibration data 47 for the first hydraulic pump 12 by changing the current command value for the first hydraulic pump 12 in a multi-step manner while the current command value output to the second hydraulic pump 13 is kept constant (preset current command value $C_{fix}$), and when acquiring the calibration data 47 for second hydraulic pump 13, acquire the calibration data 47 for the second hydraulic pump 13 by changing the current command value for the second hydraulic pump 13 in a multi-step manner while the current command value output to the first hydraulic pump 12 is kept constant (preset current command value $C_{fix}$). Herewith, when two first and second hydraulic pumps 12, 13 are installed, and even when the hydraulic control circuit is configured to supply the discharge oil by joining these first and second hydraulic pumps 12, 13, the calibration data 47 for first and second hydraulic pumps 12, 13 can be acquired smoothly.

In addition, although two hydraulic pumps are installed in the present embodiment, even when three or more hydraulic pumps are installed, the calibration data for each hydraulic pump can be acquired by acquiring the calibration data of the hydraulic pump by changing current command value corresponding to the hydraulic pump while keeping output current command value corresponding to other than the hydraulic pump obtaining the calibration data constant.

Furthermore, the acquisition of the calibration data 47 acquired by the calibration data acquisition means 48 is configured to be conducted under the conditions that the engine rotation speed is kept constant (preset engine rotation speed Ns) and the pump pressure increases as the pump capacity increases. This enables to accurately acquire the measured pump pressure data (calibration data 47) corresponding to each current command value which is acquired by measuring the pump pressure while changing the current command value output from the controller 40 in a multi-step manner from minimum to maximum current command value $C_{min}$ to $C_{max}$. Note that, in the present embodiment, as mentioned above, it is configured to create the condition that, by flowing the discharge oil of the first and second hydraulic pumps 12, 13 to the oil tank 11 via the unload oil passage 35, the engine rotation speed is kept constant and the pump pressure increases as the pump capacity increases, while positioning the first and second stick control valves 23, 24 and stick unload valve 28 at the contracted side position X and open position X of maximum stroke and fixing the stick cylinder 9 at a contracted side.

Note that the present invention is not limited to the embodiment mentioned above, so for example, the number of hydraulic pumps can be two, three, or more as mentioned above, and of course, the present invention can be embodied with one hydraulic pump. Also, the present embodiment is explained with the hydraulic pump example equipped in the hydraulic control circuit of the hydraulic excavator, but the present invention is not restricted to such example but can be embodied in the calibration of hydraulic pumps mounted on various types of hydraulic working machines.

INDUSTRIAL APPLICABILITY

The present invention can be utilized for the calibration of variable capacity hydraulic pump whose capacity is variably controlled based on current command value output from the controller.

REFERENCE SIGNS LIST

12 First hydraulic pump
13 Second hydraulic pump
40 Controller
41 Pump control table
42 Calibration part
47 Calibration data
48 Calibration data acquisition means
49 First table
50 First table creation means
51 Second table
52 Second table creation means
53 Third table
54 Third table creation means
55 Pump control table creation means

The invention claimed is:

1. A calibration system for a variable capacity hydraulic pump, the calibration system comprising: a hydraulic control circuit comprising: a hydraulic pump being driven by an engine and having a capacity variably controlled based on a current capacity control command value; and a controller programmed with a pump control table representing a relationship between pump capacity values and current capacity control command values, the controller outputting the current capacity control command value based on the pump control table to control the hydraulic pump; a calibration data acquisition means to acquire measured pump pressure data corresponding to each current capacity control command value by measuring a pump pressure corresponding to each current capacity control command value while changing the current capacity control command value output from the controller in a multi-step manner from minimum to maximum; a first table creation means for creating a first table representing a relationship between a factor and pump pressure, the factor representing a relationship between the pump pressure and pump flow rate based on the pump flow rate obtained from specification-based pump capacity at a preset current capacity control command criterion value and based on the measured pump pressure acquired by the calibration data acquisition means; a second table creation means for creating a second table representing a relationship between each current capacity control command value and measured pump pressure based on the data acquired by the calibration data acquisition means; a third table creation means for creating a third table representing a relationship between the pump flow rate and the current capacity control command value by converting the measured pump pressure in the second table into the pump flow rate using the factor in the first table and a pump control table creating means for creating a calibrated pump control table based on an engine rotation speed during pump pressure measurement and the third table; wherein the calibrated pump control table created by the pump control table creation means is used as the pump control table of the controller.

2. The calibration system for a variable capacity hydraulic pump according to claim 1, wherein the hydraulic control circuit includes multiple variable capacity hydraulic pumps, wherein the calibration data acquisition means acquires the pump pressure data sequentially for each hydraulic pump, and wherein the pump pressure data of a respective hydraulic pump is acquired by changing the current capacity control command value for the respective hydraulic pump, while keeping the current capacity control command value of the other hydraulic pumps constant.

3. The calibration system for a variable capacity hydraulic pump according to claim 1, wherein the pump pressure data is acquired by the calibration data acquisition means under a condition in which the engine rotation speed is kept constant and the pump pressure increases as the pump capacity increases.

* * * * *